US009788131B2

(12) United States Patent
McBagonluri et al.

(10) Patent No.: US 9,788,131 B2
(45) Date of Patent: Oct. 10, 2017

(54) SYSTEM AND METHOD FOR DESIGNING HEARING AID COMPONENTS WITH A FLEXIBLE COVER

(75) Inventors: Fred McBagonluri, East Windsor, NJ (US); Artem Boltyenkov, Lawrenceville, NJ (US); Oleg Saltykov, Fair Lawn, NJ (US)

(73) Assignee: Sivantos Inc., Singapore (SG)

( * ) Notice: Subject to any disclaimer, the term of this patent is extended or adjusted under 35 U.S.C. 154(b) by 3415 days.

(21) Appl. No.: 11/696,400

(22) Filed: Apr. 4, 2007

(65) Prior Publication Data

US 2008/0247579 A1 Oct. 9, 2008

(51) Int. Cl.
*H04R 25/00* (2006.01)

(52) U.S. Cl.
CPC ..... *H04R 25/65* (2013.01); *H04R 25/60* (2013.01); *H04R 25/658* (2013.01); *H04R 2225/77* (2013.01)

(58) Field of Classification Search
CPC .... H04R 25/65; H04R 25/60; H04R 2225/77; H04R 25/658; G06F 17/50
USPC ..... 703/6, 1; 381/60, 322, 324
See application file for complete search history.

(56) References Cited

U.S. PATENT DOCUMENTS 6,920,414 B2 * 7/2005 Tøpholm ..... 703/1
7,801,708 B2 * 9/2010 Unal et al. ..... 703/2
8,032,337 B2 * 10/2011 Deichmann et al. ..... 703/1
2002/0138237 A1 * 9/2002 Topholm ..... 703/1
2004/0107080 A1 6/2004 Deichmann
2004/0264723 A1 12/2004 Saltykov
2011/0289764 A1 * 12/2011 Parsi ..... H04R 25/60 29/594
2012/0232857 A1 * 9/2012 Fisker ..... B29C 33/3835 703/1

FOREIGN PATENT DOCUMENTS

WO 2007011421 A1 1/2007

OTHER PUBLICATIONS

Communication dated Oct. 24, 2011 from the European Patent Office for Application Serial No. 08 251 021.5.

(Continued)

*Primary Examiner* — Davetta W Goins
*Assistant Examiner* — Phylesha Dabney
(74) *Attorney, Agent, or Firm* — Laurence A. Greenberg; Werner H. Stemer; Ralph E. Locher

(57) ABSTRACT

A method and appertaining system for implementing the method is provided for designing hearing aids having flexible parts. Three-dimensional data is provided that is related to both a soft part and a hard part of a hearing aid component into a computer-based system. Additionally, information is entered related to material characteristics for both the soft part and the hard part of the component. A component within the hearing aid shell is placed and moved in a model generated by the system. Forces, stresses, and/or amount of deformation for parts of the component based on the location of the component and at least one of another component and the shell are calculated, and the three-dimensional data model of the shell is revised based upon the calculated degree of deformation, forces, and/or stresses.

3 Claims, 4 Drawing Sheets

(56) References Cited

OTHER PUBLICATIONS

Wikipedia, "Finite Element Method", Feb. 9, 2007, retrieved from the internet: URL: http://en.wikipedia.org/w/index.php?title=Finite_element_method&oldid=106831309.
Ansys, "Ansys—Mechanical Solution", Jan. 1, 2005, retrieved from the internet: URL:http://web.archive.org/web/20070207132858/http://www.ansys.com/assets/brochures/mechanical-solution-10.pdf.
Oticon, "Mechanical Design", Jan. 1, 2006, retrieved from the internet: URL:http://web.archieve.org/web/20061018201409/http://www.job.oticon.com/eprise/main/Oticon/Job_en/SEC_Job_engelsk/WorkingInOticon/WorkAreas/WorkAreaDescriptionKongebakken/CNT03_MechanicalDesign.
European Search Report from Application Serial No. 08251021.5 dated Dec. 8, 2010.

* cited by examiner

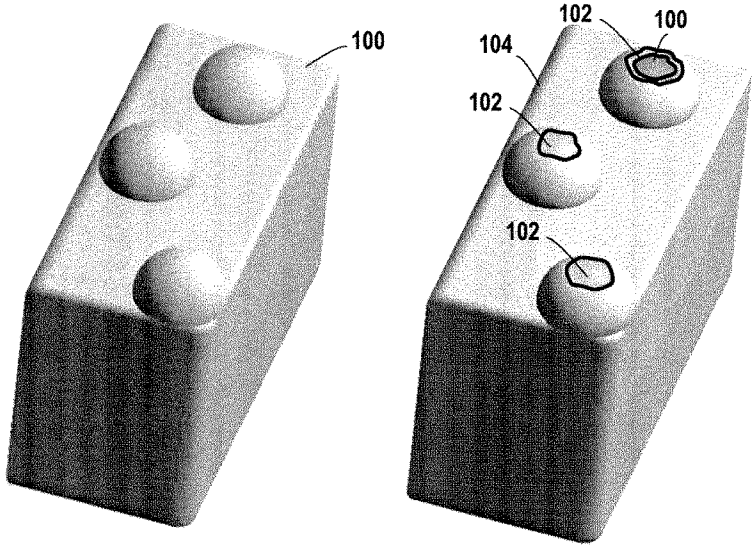
FIG. 7
FIG. 8
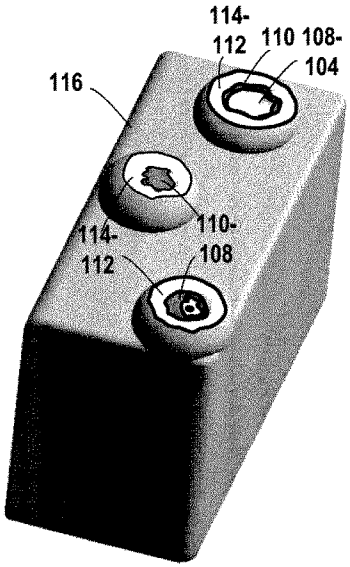
FIG. 9

SYSTEM AND METHOD FOR DESIGNING HEARING AID COMPONENTS WITH A FLEXIBLE COVER

BACKGROUND

One of the fundamental criteria in the design of hearing aids is to minimize size. As the current trend in the hearing aid industry continues to make shells smaller, the size requirement implies that every tenth of a millimeter of the shell height plays an important role in the determination of its the overall size. This makes the need for accurate representation of virtual models of components in the shell during modeling very important.

SUMMARY

The present invention provides system and method for a precise representation and handling of electronic components inside the hearing aid shell in which the physical structure of the components can be accounted for. Components inside the shell, particularily a receiver, a hybrid, etc., typically comprise the "hard part" (the component itself), and the "soft part" (e.g., some form of resin boot around the component to avoid direct contact of component with the shell) The focus thus is on the correct handling of components that consist of hard and soft parts in computerized software systems.

DEFINITIONS AND ABBREVIATIONS

The following definitions and abbreviations are used herein.

ear impression A 3D impression from a patient's ear. The actual physical impression is scanned by 3D scanners to create a pointcloud.

pointcloud A set of 3D coordinates. Pointcloud files that come from 3D scanners are usually in ASCII format.

work order An entry in a DWOM that contains all information relevant for modelling a shell (or shells in case of binaural order) for the specific order of the ITE hearing instrument.

3D 3-Dimensional

ASCII American Standard Code for Information Interchange. A standard for assigning numerical values to the set of letters in the Roman alphabet and typographic characters.

AutoMoDe Automatic Modeling and Detailing Software

DWOM Digital Work Order Management; DWOM is the interface between AutoMoDe and back-end/business systems like SMART. DWOM is based on Microsoft COM.

elasticity The ability of a body to resist a distorting influence or stress and to return to its original size and shape when the stress is removed. All solids are elastic for small enough deformations or strains, but if the stress exceeds a certain amount known as the elastic limit, a permanent deformation is produced. Both the resistance to stress and the elastic limit depend on the composition of the solid. Some different kinds of stresses are tension, compression, torsion, and shearing. For each kind of stress and the corresponding strain there is a modulus, i.e., the ratio of the stress to the strain; the ratio of tensile stress to strain for a given material is called its Young's modulus ERP/CRM Enterprise Resource Planning/Customer Relationship Management ITE Inside The Ear N/A Not Applicable RSM Rapid Shell Manufacturing Software SMART The ERP/CRM system upon which SHI runs its business SLA Stereolithography (a manufacturing method utilising laser beams & liquid polymers)

SLS Selective Laser Sintering (a manufacturing method utilizing laser beams & polyamide powder)

STL File format for 3D representations of objects; used as input for SLA & SLS. There are two versions of STL formats: binary and ASCII.

Young's modulus Number representing (in pounds per square inch or dynes per square centimeter) the ratio of stress to strain for a wire or bar of a given substance. According to Hooke's law, the strain is proportional to stress, and therefore the ratio of the two is a constant that is commonly used to indicate the elasticity of the substance. Young's modulus is the elastic modulus for tension, or tensile stress, and is the force per unit cross section of the material divided by the fractional increase in length resulting from the stretching of a standard rod or wire of the material UI User Interface The present invention provides the software implementation of representative electronic component behavior in a hearing aid instrument. This requires the modeling of flexible material behavior, representative deformation modeling, and dynamic constraints modeling. Within the context of this implementation, electronic components are modeled as comprising a hard core and a soft exterior. While the internal core remains intact during virtual and physical component placement, the exterior cover undergoes flexural motion when exposed to contact forces. In the prior art automation software systems available for hearing instrument design, these concepts are completely absent, although the general basis for correct replication of physical assemblying protocols in hearing instrument manufacturing and for process automation is known.

The goal of the present invention is to mimic the behaviour of the components having soft parts in computerized 3D models to have the models behave as identical as possible to that of the real world.

The handling of components with a flexible cover does not require any special user interactions, and can be seamlessly integrated into other systems that automate the hearing aid design and manufacturing. Therefore, during the positioning of the components in the system software, the physical structure of the components in real world will be accounted for in 3D model's behaviour.

Accordingly, a method is provided for designing hearing aids having flexible parts, comprising entering three dimensional data related to both a soft part and a hard part of a hearing aid component into a computer-based system; entering information related to material characteristics for both the soft part and the hard part of the component; placing and moving the component within a hearing aid shell in a model generated by the system; calculating forces, stresses, and degree of deformation for parts of the component based on the location of the component and at least one of another component and the shell; and revising the three dimensional data model based upon the calculated degree of deformation.

Similarly, an appertaining system is provided for designing hearing aids having flexible parts, comprising an input mechanism for entering three dimensional data related to both a soft part and a hard part of a hearing aid component; a first storage area for storing the three-dimensional data; a second storage area for storing information related to material characteristics for both the soft part and the hard part of the component; a software routine for placing and moving the component within a hearing aid shell in a model generated by the system; a software routine for calculating forces, stresses, and degree of deformation for parts of the component based on the location of the component and at least one of another component and the shell; and a software routine for revising the three dimensional data model based upon the calculated degree of deformation.

DESCRIPTION OF THE DRAWINGS

The invention is described with respect to various preferred embodiments as illustrated in the drawing figures and appertaining descriptive text below.

FIGS. 7-9 are pictorial views showing deformation of the flexible part without the plate, and correspond with FIGS. 3, 4, & 6 respectively.

DETAILED DESCRIPTION OF THE PREFERRED EMBODIMENTS

Figure 1:
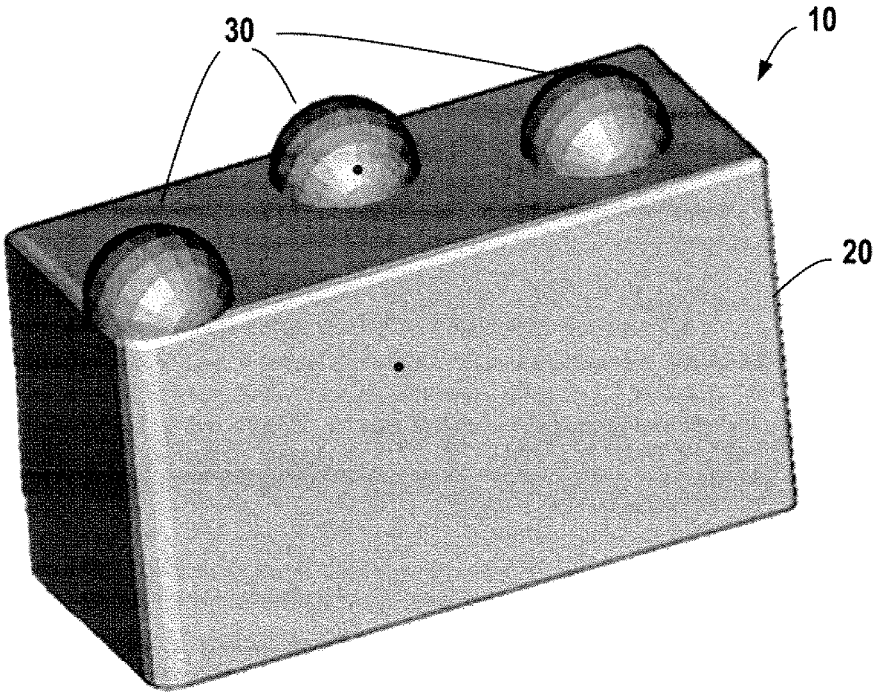
FIG. 1 is a pictorial isometric view of a component with flexible cover.

FIG. 1 illustrates a component with flexible cover 10 comprising the component itself 20 with the flexible cover 30 (represented by the hemispherical protrusions) attached to the component 20. The illustration in FIG. 1 is what might be viewed by a user of the system on a user interface device of the 3D modeling system, although in a preferred embodiment, color could be used to represent the various separate portions.

Components with flexible covers are movable on the display and within the system model space in the same way as components without flexible covers are movable. Each component with a flexible cover 10 comprises a hard part and a soft part, where the hard part is the component itself 20 and the soft part 30 is the flexible cover. Both the hard part and the soft part can be represented by corresponding STL files.

If the component with flexible cover 10 touches a shell of the hearing aid, then the component shape is adapted to match the behaviour of the flexible cover in the real world. Collision notification is not triggered for the soft part as it would be for the hard part if the hard part were to intersect with the shell or other hard part components; the soft part is not permitted to penetrate into the shell.

In the case where the soft part of the component is about to penetrate the shell, the necessary deformation calculations are applied on the soft part of the component to calculate a new deformed shape of the soft part. In case several soft parts of several different components are about to penetrate each other, necessary deformation calculations are applied on the soft part of all involved components.

This is achieved by the software ensuring that forces applied to each component create a zero sum together. If any of the components have a sum of all forces applied to it that differs from zero, then the software automatically repositions the component in the nearest position at which a zero sum can be achieved. This is accomplished by moving the component in the software, in a direction of the non-zero-value vector until the sum of the forces is zero.

Figure 2:
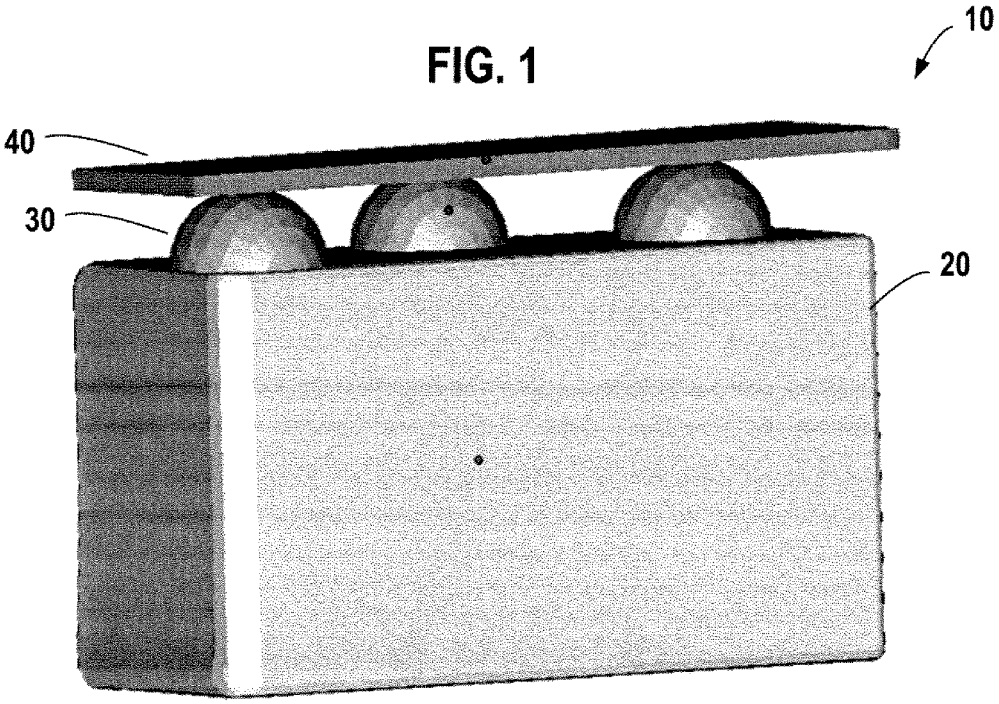
FIG. 2 is a pictorial view of the component of FIG. 1 having a plate positioned over the flexible cover.

On every place where a flexible cover is about to penetrate the shell, the forces pushing e.g., a receiver from the surfaces are applied to the flexible cover to calculate the necessary modifications. FIG. 2 provides a view of an illustrative simulation. In this Figure, a plate 40 is positioned above the component with flexible cover 10 for the purpose of simulating the calculation of flexible cover deformations.

This plate 40 simulates a hearing aid shell wall (discussed below). In a real life application, there is no plate provided by the software, and the component with flexible cover 10 interacts with the 3D objects present in the design space (e.g. the shell, other components). The hard part of the component is not permitted to be deformed, but the soft part of the component is allowed to be deformed according to a known finite element analysis approach. With this approach, the soft part of the component is represented by a geometrically similar model consisting of multiple, linked, simplified representations of discrete regions—i.e., finite elements on an unstructured grid. Equations of equilibrium, in conjunction with applicable physical considerations such as compatibility and constitutive relations, are applied to each element, and a system of simultaneous equations is constructed. The system of equations is solved for unknown values using the techniques of linear algebra or nonlinear numerical schemes. Although this is an approximate method, the accuracy of this approach can be improved by refining the mesh in the model using more elements and nodes.

The software provides the possibility to specify the materials from which hard and soft parts of each component are created. As a part of material specification, Young's modulus may be utilized. For example, Young's modulus for Viton is 0.8 MPa, and Young's modulus for steel $2*10^5$ MPa.

The know techniques utilized may be found in the following references, which are herein incorporated by reference: Kreyszig, E., Advanced Engineering Mathematics, John Wiley and Sonds, Inc., New York (1962); Lekhnitskii, S. G., Theory of Elasticity of an Anisotropic Elastic Body, Holden-Day, San Fransisco (1963); Oden, J. T., Mechanics of Elastic Structures, McGraw-Hill, New York (1968); and Przemieniecki, J. S., Theory of Matrix Structural Analysis, McGraw-Hill, New York (1968). Furthermore, analysis tools, such as the ANSYS software produced by ANSYS, Inc., or software modultes having similar functionality may be utilized.

FIGS. 3-9 illustrate an actual simulation, based on an exemplary configuration, and demonstrate the software handling of the pressure applied to the flexible cover 30 of the component 20; the plate pressure on the component with the flexible cover 10 was simulated. The simulation assumed that the component 20 and the plate 40 were made of steel, and flexible cover 30 is made of Viton material. Corresponding Young's modulus values for the materials were accounted for during the simulation process.

FIGS. 3-9 illustrate how the model behaves when the flexible cover 30 receives pressure by the shell wall. For the sake of illustration, the following reference characters will be used to illustrate X-axis direction deformation value ranges, which in this case are represented as microns ($10^{-6}$ m) of displacement from an initial position before the force was applied.

TABLE 1

| Displacement Reference Characters | |
|---|---|
| Ref. Char. | Displacement in Microns from Pre-force Initial Position |
| 100 | −0.345 to −0.306 |
| 102 | −0.306 to −0.268 |
| 104 | −0.268 to −0.229 |
| 106 | −0.229 to −0.190 |
| 108 | −0.190 to −0.152 |
| 110 | −0.152 to −0.113 |
| 112 | −0.113 to −0.074 |
| 114 | −0.074 to −0.035 |
| 116 | −0.035 to 0.003 |

Figure 3:
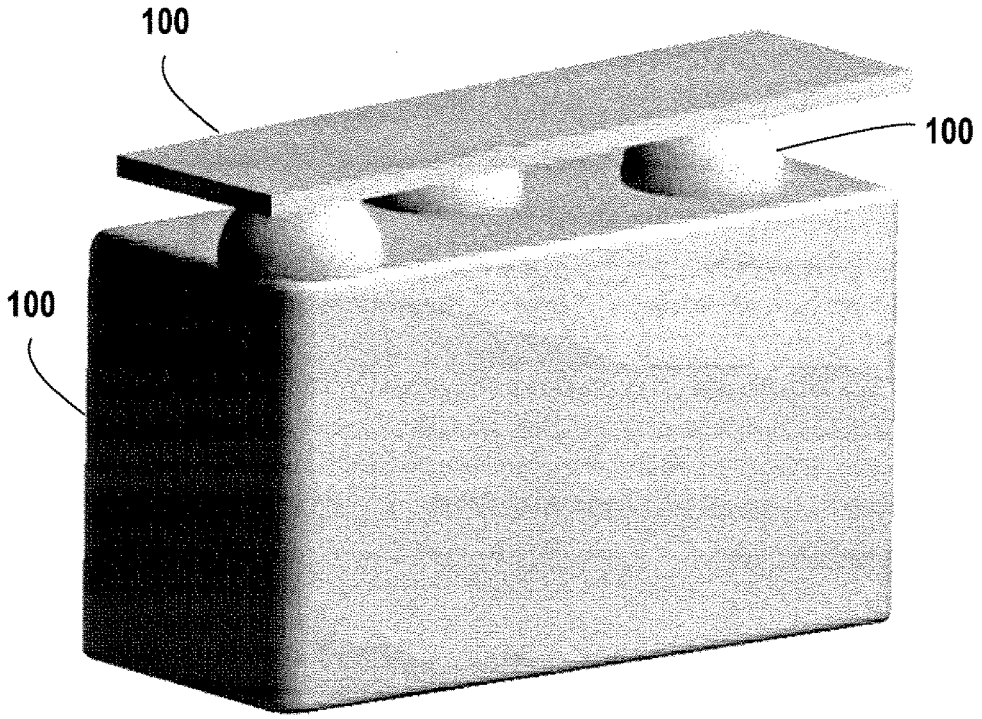
FIG. 3 is a pictorial view of the component with plate in an initial position and no pressure.

FIG. 3 illustrates the initial position of the plate 40 and flexible cover 30. As illustrated in the Figure, there is a minimal deformation level 100 on the entire assembly 10, 40.

Figure 4:
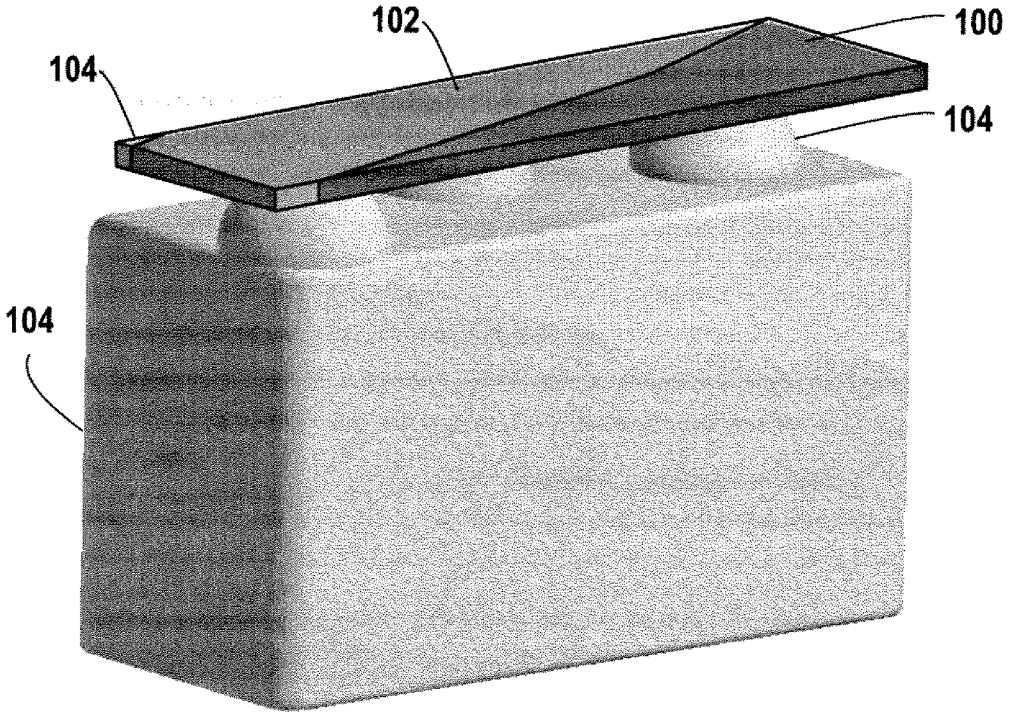
FIG. 4 is a pictorial view of the component with plate in a position in which force is starting to be applied on the flexible cover.
Figure 5:
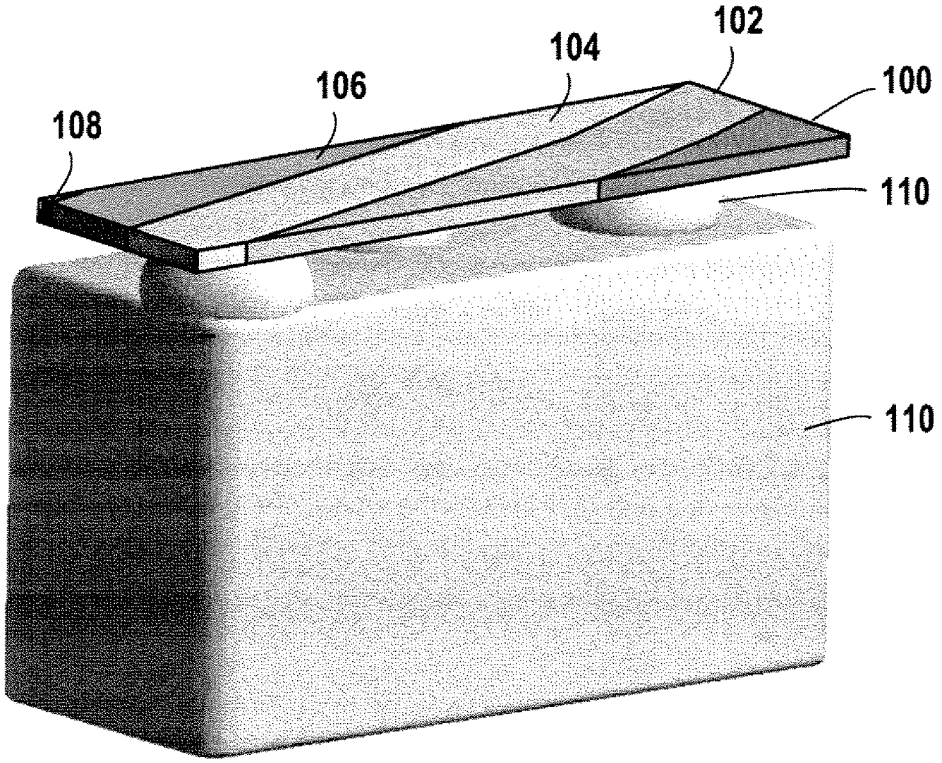
FIG. 5 is a pictorial view of the component with plate in a position in which a further force is being applied on the flexible cover.
Figure 6:
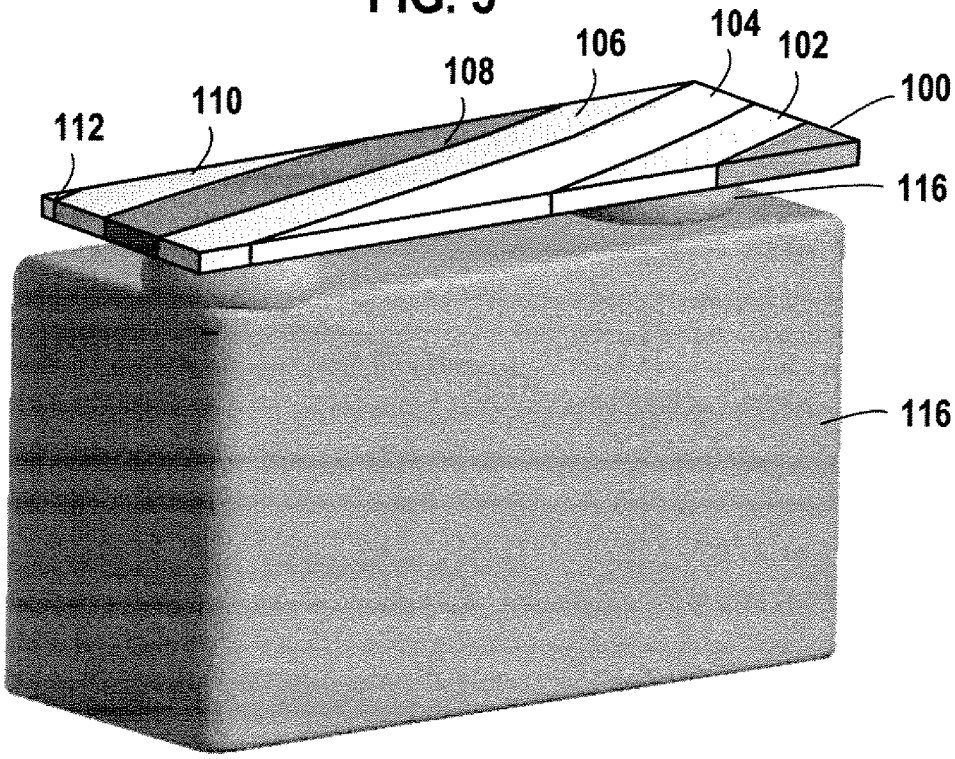
FIG. 6 is a pictorial view of the component with plate in a position in which a high force is being applied on the flexible cover.

FIGS. 4-6 illustrate the effects after pressure is applied to the component 20 with the flexible cover 30 by the user moving the component with cover 10 towards the shell wall. The flexible cover is deformed according to the applied stress and elasticity of the materials from which the component 20 and flexible cover 30 are created. FIGS. 4-6 illustrate a progression where the component with flexible cover 10 moves towards the shell wall (illustrated by the plate 40). The displacement regions are represented by lined regions in the Figures, and range from a low range 100 to a moderate range 104.

When the user moves the component 10 back from the shell wall 40, the deformation of flexible cover parts 30 is gradually removed to reflect the change in the forces applied to the component with flexible cover 10.

FIGS. 7-9 illustrate the process described above, but provides a view without the shell/plate 40. These Figures show the areas of the flexible cover material 30 where the forces were applied—this makes it possible to see how the flexible cover material 30 is deformed, as illustrated in the software.

The FIG. 7 shows the initial situation of component with flexible cover without pressure from the shell wall—a low degree of deformation 100 is present over all of the component 10.

When the pressure is applied, the flexible cover 30 is deformed in the software as shown in FIG. 8. Finally, FIG. 9 illustrates the maximum amount of pressure utilized in the simulation. When the stress is decreased, then the deformation is changed accordingly to reflect the changes in the forces. Advantageously, an ultimate design configuration is possible in which some of the soft parts are deformed, as long as a predefined criteria (such as the limit of deformation or possibly force-related parameters) is met. If such a limit is exceeded, then (given this predefined criteria, such as the limits of deformation) the software can indicate a collision. This capability is not possible in systems of the prior art in which such a configuration with the soft parts would show up as a collision—therefore, this system permits designs that are not possible with the other systems.

For the purposes of promoting an understanding of the principles of the invention, reference has been made to the preferred embodiments illustrated in the drawings, and specific language has been used to describe these embodiments. However, no limitation of the scope of the invention is intended by this specific language, and the invention should be construed to encompass all embodiments that would normally occur to one of ordinary skill in the art.

The present invention may be described in terms of functional block components and various processing steps. Such functional blocks may be realized by any number of hardware and/or software components configured to perform the specified functions. For example, the present invention may employ various integrated circuit components, e.g., memory elements, processing elements, logic elements, look-up tables, and the like, which may carry out a variety of functions under the control of one or more microprocessors or other control devices. Similarly, where the elements of the present invention are implemented using software programming or software elements the invention may be implemented with any programming or scripting language such as C, C++, Java, assembler, or the like, with the various algorithms being implemented with any combination of data structures, objects, processes, routines or other programming elements. The invention can be implemented in a computer running any Microsoft Windows operating system, such as Windows 2000, Windows XP, Windows Vista, or the like, or any Macintosh, Unix-based, or any other operating system on a computer system ranging from a personal laptop or palmtop to mainframe servers, where applicable. Furthermore, the present invention could employ any number of conventional techniques for electronics configuration, signal processing and/or control, data processing and the like. The word mechanism is used broadly and is not limited to mechanical or physical embodiments, but can include software routines in conjunction with processors, etc.

The particular implementations shown and described herein are illustrative examples of the invention and are not intended to otherwise limit the scope of the invention in any way. For the sake of brevity, conventional electronics, control systems, software development and other functional aspects of the systems (and components of the individual operating components of the systems) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential to the practice of the invention unless the element is specifically described as "essential" or "critical". Numerous modifications and adaptations will be readily apparent to those skilled in this art without departing from the spirit and scope of the present invention.

| TABLE OF REFERENCE CHARACTERS | |
|---|---|
| 10 | component with flexible cover |
| 20 | component |
| 30 | flexible cover |
| 40 | plate |
| 100-116 | deformation ranges |

What is claimed is:

1. A method for designing a hearing instrument, comprising:

generating a virtual three-dimensional model of a hearing instrument comprising a shell and a plurality of hearing instrument components within the shell, where at least one of the components comprises a deformable surface and the model further comprises characteristics of the materials of that component;

calculating the forces bearing on that component; and determining whether the sum of all of the forces on that component results in a vector of zero force, and, if not, repositioning the component within the shell until the sum of the forces on the component equals zero.

2. The method according to claim 1, where repositioning comprises moving the component along the vector of non-zero force.

3. The method according to claim 1, where the components comprise dimensions, the method further comprising: observing the degree of deformation of the at least one of the components comprising a deformable surface: and revising the virtual three-dimensional model in response to the deformation observed in that component, where revising the model comprises revising the dimensions of the component.

* * * * *